US008956153B2

(12) United States Patent
Huang et al.

(10) Patent No.: US 8,956,153 B2
(45) Date of Patent: Feb. 17, 2015

(54) SECURITY DEVICE FOR GAS APPLIANCE OPERATING IN AN ENVIRONMENT WITH INSUFFICIENT OXYGEN

(71) Applicant: Grand Mate Co., Ltd., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Kuan-Chou Lin, Taichung (TW); Yen-Jen Yeh, Yunlin (TW)

(73) Assignee: Grand Mate Co., Ltd., Taichung (TW)

( * ) Notice: Subject to any disclaimer, the term of this patent is extended or adjusted under 35 U.S.C. 154(b) by 12 days.

(21) Appl. No.: 13/777,395

(22) Filed: Feb. 26, 2013

(65) Prior Publication Data

US 2014/0134549 A1 May 15, 2014

(30) Foreign Application Priority Data

Nov. 9, 2012 (TW) ..... 101141819 A

(51) Int. Cl.

| | |
|---|---|
| ***F23N 5/26*** | (2006.01) |
| ***F23N 5/10*** | (2006.01) |
| ***F23N 5/24*** | (2006.01) |
| ***F23N 1/00*** | (2006.01) |

(52) U.S. Cl.

CPC ..... *F23N 5/245* (2013.01); *F23N 1/002* (2013.01); *F23N 5/102* (2013.01); *F23N 5/242* (2013.01); *F23N 2031/00* (2013.01); *F23N 2035/12* (2013.01)

USPC ..... 431/14; 431/80

(58) Field of Classification Search

CPC ..... F23N 1/005; F23N 5/10; F23N 5/105; F23N 5/102; F23N 5/109

USPC ..... 431/14, 80; 110/190

See application file for complete search history.

(56) References Cited

U.S. PATENT DOCUMENTS

| | | | | |
|---|---|---|---|---|
| 3,072,468 | A * | 1/1963 | Stitzer | 48/180.1 |
| 3,792,671 | A * | 2/1974 | Woods | 110/346 |
| 4,480,986 | A * | 11/1984 | Nelson et al. | 431/37 |
| 2003/0087600 | A1 * | 5/2003 | Meneely, Jr. | 454/343 |
| 2003/0183177 | A1 * | 10/2003 | Kobayashi et al. | 122/13.01 |
| 2012/0255219 | A1 * | 10/2012 | DeMonte et al. | 43/124 |

* cited by examiner

*Primary Examiner* — Avinash Savani
*Assistant Examiner* — Vivek Shirsat
(74) *Attorney, Agent, or Firm* — Ming Chow; Sinorica, LLC

(57) ABSTRACT

A gas appliance has a security device and a combustor. The security device has a gas valve, a thermocouple, and a controller. The thermocouple receives a heat of the combustor and generates thermoelectric potential accordingly. The controller controls the gas valve according to the thermoelectric potential. While the thermoelectric potential is lower than a high level, the controller controls the gas valve to reduce the gas supplied to the combustor, and while the thermoelectric potential is lower than a low level the controller controls the gas valve to stop the gas supplied to the combustor to avoid the incomplete burning because of insufficient oxygen.

8 Claims, 3 Drawing Sheets

SECURITY DEVICE FOR GAS APPLIANCE OPERATING IN AN ENVIRONMENT WITH INSUFFICIENT OXYGEN

The current application claims a foreign priority to the patent application of Taiwan No. 101141819 filed on Nov. 9, 2012.

BACKGROUND OF THE INVENTION

1. Field of the Invention

The present invention relates generally to a device which burns gas, and more particularly to a protective device for a gas appliance operating in an environment with insufficient oxygen.

2. Description of the Related Art

Gas appliance is a device which burns gas to heat something, such as water heater, gas stove, or fireplace. The common accident caused by the gas appliance is carbon monoxide poisoning. The carbon monoxide is produced from incomplete burning, and there will be an incomplete burning if the gas appliance is operating in a poor ventilation environment. Carbon monoxide is colorless and odorless to kill people in silent.

In complete burning, the gas appliance will generate carbon dioxide and water, and carbon monoxide will be generated from incomplete burning. The accident usually happens in wintertime, people close the windows, and that will stop the ventilation in the room. If the gas appliance is operating in that room, carbon monoxide will quickly accumulated in the room and cause accident.

Oxygen is an important element for life. Earth's atmosphere contains roughly 78.08% nitrogen, 20.95% oxygen, 0.93% argon, 0.03% carbon dioxide, and other rare gases. Typically, oxygen concentration should be 20.5% or more in a normal room to keep human's life, and in a government's rule, there should be at least 18% oxygen in a room.

In order to avoid the incomplete burning in the gas appliance when it is operating in a room of poor ventilation, a security device is provided to be incorporated in the gas appliance. A conventional security device includes a thermocouple 50 and a gas valve 60. The thermocouple 50 is around a burner 40 of the gas appliance to generate a thermoelectric potential because of a heat of the burner 40. The gas valve 60 has a coil 62, a magnet 64, a spring 66, and a gate 68. The coil 62 is electrically connected to the thermocouple 50 to receive the thermoelectric potential and generate a magnetic field to attract the magnet 64 so as to compress the spring 64, and then the gate 68 will be opened to supply the burner 40 with gas. It is easy to understand that the heat of the burner 40 is inversely proportional to the gate 68 to be opened. The gate 68 will be opened wider while the heat of the burner 40 is higher, and the gate 68 will be closed while the heat is lower than a predetermined level. So that, if incomplete burning occurs, the heat of the burner 40 drops to make the gate 68 be closed a little to reduce the gas for the burner 40, and if the incomplete burning becomes more and more serious, the gate 68 will be totally closed to cut off the gas.

It is obvious that the conventional security device is working by magnetic force and spring force. Fatigue and jam of the elements will make the security device malfunction or failure.

SUMMARY OF THE INVENTION

The primary objective of the present invention is to provide a security device for a gas appliance to operate in an environment with insufficient oxygen, which has less risk of malfunction or failure and works accurately.

According to the objective of the present invention, the present invention provides a security device for a combustor, which burn gas, to determine an oxygen concentration around the combustor. The security device includes a gas valve, a thermocouple, and a controller. The gas valve is controlled by electrical signals to provide gas to the combustor. The thermocouple is provided beside the combustor to generate a thermoelectric potential because of a heat of the combustor, wherein the thermoelectric potential is directly proportional to the heat of the combustor. The controller is electrically connected to the gas valve and the thermocouple, wherein the controller receives the thermoelectric potential from the thermocouple and controls the gas valve accordingly.

In an embodiment, the controller compares the thermoelectric potential with a low level, and controls the gas valve to stop the gas supplied to the combustor while the thermoelectric potential is lower than the low level.

In an embodiment, the controller compares the thermoelectric potential with a high level, and controls the gas valve to reduce the gas supplied to the combustor while the thermoelectric potential is lower than the high level.

In an embodiment, the controller compares the thermoelectric potential with a high level, and partially closes the gas valve to reduce the gas supplied to the combustor while the thermoelectric potential is lower than the high level and is higher than the low level.

In an embodiment, the controller includes a control unit and a comparison unit; the control unit is electrically connected to the gas valve; the comparison unit is electrically connected to the thermocouple to receive the thermoelectric potential from the thermocouple and compare the thermoelectric potential with a low level; and the control unit closes the gas valve to stop the gas supplied to the combustor while the thermoelectric potential is lower than the low level.

In an embodiment, the comparison unit further compares the thermoelectric potential with a high level and controls the gas valve to reduce the gas supplied to the combustor while the thermoelectric potential is lower than the high level and is higher than the low level.

In an embodiment, the security further includes a fan electrically connected to the controller to be started to exhaust air while the thermoelectric potential is lower than the high level.

In an embodiment, the security further includes an alarm electrically connected to the controller to sound an alarm when the thermoelectric potential is lower than the high level.

In an embodiment, the gas valve is provided with a receiver, and controller is provided with a transmitter so that the controller controls the gas valve through a wireless communication.

In an embodiment, the present invention provides a gas appliance, including a combustor, which burns gas; a gas pipe connected to the combustor to supply the combustor with gas; a gas valve, which is controlled by electrical signals, connected to the gas pipe to control the gas supplied to the combustor; a thermocouple provided beside the combustor to generate a thermoelectric potential because of a heat of the combustor, wherein the thermoelectric potential is directly proportional to the heat of the combustor; and a controller electrically connected to the gas valve and the thermocouple, wherein the controller receives the thermoelectric potential from the thermocouple and controls the gas valve accordingly.

In an embodiment, the present invention provides a gas appliance, including a combustor, which burns gas; a gas pipe connected to the combustor to supply the combustor with gas;

a gas valve, which is activated by electrical signals, connected to the gas pipe to control the gas supplied to the combustor; an air blower for supplying the combustor with air; a thermocouple provided beside the combustor to generate a thermoelectric potential because of a heat of the combustor, wherein the thermoelectric potential is directly proportional to the heat of the combustor; and a controller electrically connected to the gas valve, the air blower and the thermocouple, wherein the controller receives the thermoelectric potential from the thermocouple and controls the gas valve and the air blower accordingly. The controller controls the gas valve to reduce the gas supplied to the combustor and speeds up the air blower while the thermoelectric potential is lower than a predetermined level.

Therefore, the present invention may protect user from being hurt by carbon monoxide, and it provide a reliable system in sensing the combustor 10 with high accuracy.

DETAILED DESCRIPTION OF THE INVENTION

The detailed description and technical contents of the present invention will be explained with reference to the accompanying drawings. However, the drawings are illustrative only but not used to limit the present invention.

Figure 1:
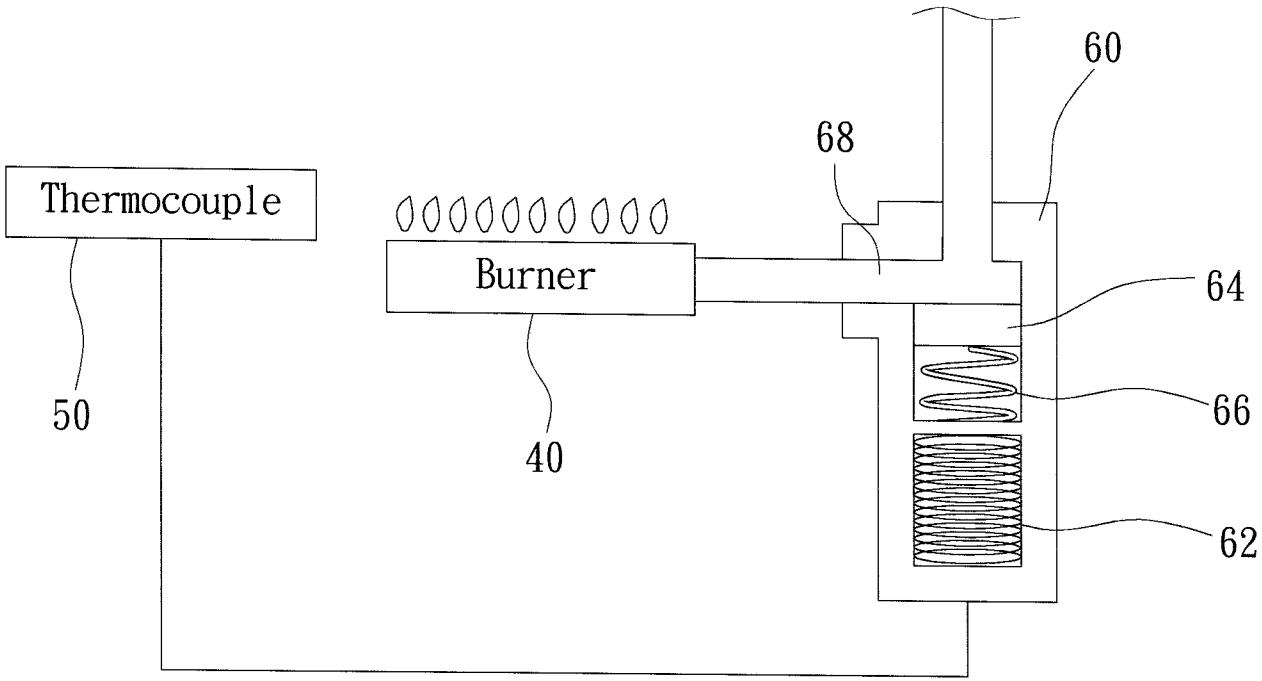
FIG. 1 (PRIOR ART)
FIG. 1 is a block diagram of the conventional security device for the gas appliance.
Figure 2:
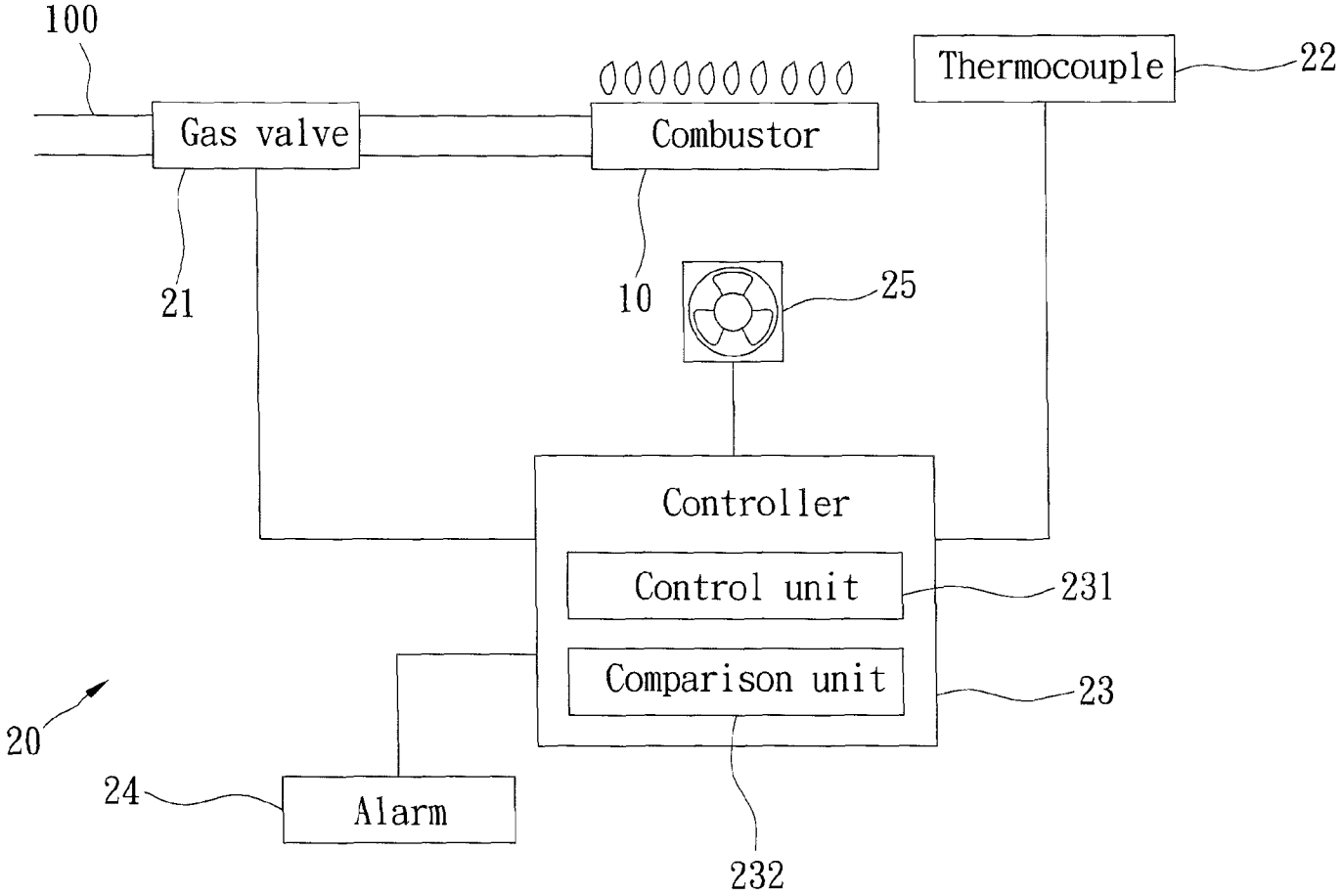
FIG. 2 is a block diagram of a first preferred embodiment of the present invention.

As shown in FIG. 2, a gas appliance of the first preferred embodiment of the present invention includes a combustor 10 and a security device 20. The combustor 10 is a conventional device which burner gas to heat something. The security device 20 has a gas valve 21, a thermocouple 22, a controller 23, an alarm 24, and an fan 25.

The gas valve 21 is mounted on a gas pipe 100 which supply the combustor 10 with gas. The gas valve 21 is activated by electrical signals to change a gas flow in the gas pipe 100.

The thermocouple 22 is around the combustor 10. According to the Seeback effect, the thermocouple 22 generates a thermoelectric potential because of a heat of the combustor 10, and the thermoelectric potential is directly proportional to the heat of the combustor 10.

The controller 23 has a control unit 231 and a comparison unit 232. The control unit 231 is electrically connected to the gas valve 21 to control it. The comparison unit 232 is respectively connected to the control unit 231 and the thermocouple 22. The comparison unit 232 is stored with a low level and a high level, and the high level is greater than the low level. The low level is a predicted potential value, which indicates insufficient oxygen in the environment, for instance, 18% oxygen, and the high level is a predicted potential value, which indicates sufficient oxygen in the environment, for instance, 20.5% oxygen. The comparison unit 232 receives the thermoelectric potential from the thermocouple 22 and compares the thermoelectric potential with the low level and the high level.

While the thermoelectric potential from the thermocouple 22 is lower than the low level, it indicates that there is insufficient oxygen for the combustor 10 so that the control unit 231 closes the gas valve 21 to cut off the gas for the combustor 10 so as to stop burning. While the thermoelectric potential is higher than the high level, it indicates that there is sufficient oxygen for the combustor 10 so that the control unit 231 opens the gas valve 21 to provide gas to the combustor 10.

While the thermoelectric potential is between the low level and the high level, the control unit 231 partially opens the gas valve 21 to reduce the gas for the combustor 10. At the same time, the control unit 231 controls the alarm 23 to sound an alarm in order to warn people. Besides, the control unit 231 turns on the fan 25 for ventilation to reduce a risk of carbon monoxide poisoning. The alarm 23 and the fan 25 keeps running when the thermoelectric potential is lower than the low level.

Figure 3:
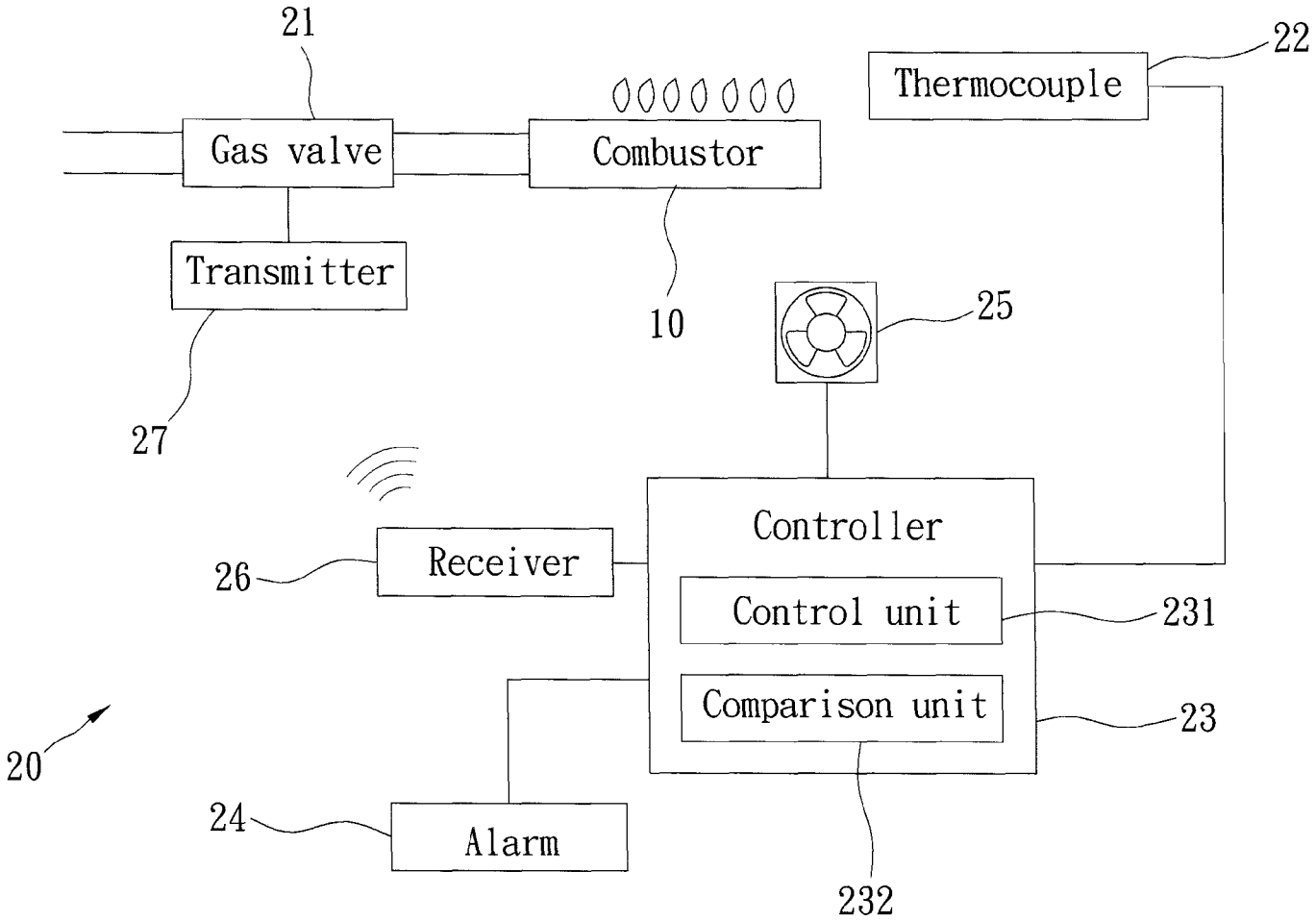
FIG. 3 is a block diagram in part of a second preferred embodiment of the present invention.

FIG. 3 shows a security device 20 of the second preferred embodiment of the present invention, which is the same as the first preferred embodiment and further includes a receiver 26 and a transmitter 27. The receiver 26 is connected to the gas valve 21, and the transmitter 27 is connected to the controller 23, so that the controller 23 may control the gas valve 21 through wireless communication.

With the designs as described above, the present invention may protect user from being hurt by carbon monoxide, and it provide a reliable system in sensing the combustor 10 with high accuracy.

While the security device of the present invention is incorporated in a gas appliance with an air blower, which provide the combustor with air, the security device may be connected to the air blower to control it. The security device speeds up the air blower and partially close the gas valve when it detects that there may be insufficient oxygen. This will increase the air to the combustor as well as reduce the gas to the combustor to reduce the chance of occurring incomplete burning.

It is easy to understand that it may provide single level or multiple levels to determine the oxygen concentration. The description above is a few preferred embodiments of the present invention, and the equivalence of the present invention is still in the scope of claim construction of the present invention.

What is claimed is:

1. A security device for a combustor, which burn gas, to determine an oxygen concentration around the combustor, comprising:

a gas valve which is controlled by electrical signals to provide gas to the combustor;

a thermocouple provided beside the combustor to generate a thermoelectric potential because of a heat of the combustor, wherein the thermoelectric potential is directly proportional to the heat of the combustor; and a controller electrically connected to the gas valve and the thermocouple, wherein the controller receives the thermoelectric potential from the thermocouple and controls the gas valve accordingly;

wherein the controller compares the thermoelectric potential with a low level, and controls the gas valve to stop the gas supplied to the combustor while the thermoelectric potential is lower than the low level;

wherein the controller compares the thermoelectric potential with a high level, and partially closes the gas valve to reduce the gas supplied to the combustor while the thermoelectric potential is lower than the high level and is higher than the low level;

wherein the low level is a predicted potential value, which indicates insufficient oxygen in the environment, and the high level is a predicted potential value too, which indicates sufficient oxygen in the environment;

wherein the thermoelectric potential decreases along with less oxygen around the combustor.

2. The security device as defined in claim 1, wherein the controller includes a control unit and a comparison unit; the control unit is electrically connected to the gas valve; the comparison unit is electrically connected to the thermocouple to receive the thermoelectric potential from the thermocouple and compare the thermoelectric potential with a low level; and the control unit closes the gas valve to stop the gas supplied to the combustor while the thermoelectric potential is lower than the low level.

3. The security device as defined in claim 2, wherein the comparison unit further compares the thermoelectric potential with a high level and controls the gas valve to reduce the gas supplied to the combustor while the thermoelectric potential is lower than the high level and is higher than the low level.

4. The security device as defined in claim 1, further comprising a fan electrically connected to the controller to be started to exhaust air while the thermoelectric potential is lower than the high level.

5. The security device as defined in claim 1, further comprising an alarm electrically connected to the controller to sound an alarm when the thermoelectric potential is lower than the high level.

6. The security device as defined in claim 1, wherein the gas valve is provided with a receiver, and controller is provided with a transmitter so that the controller controls the gas valve through a wireless communication.

7. A gas appliance, comprising:

a combustor, which burns gas;

a gas pipe connected to the combustor to supply the combustor with gas;

a gas valve, which is controlled by electrical signals, connected to the gas pipe to control the gas supplied to the combustor;

a thermocouple provided beside the combustor to generate a thermoelectric potential because of a heat of the combustor, wherein the thermoelectric potential is directly proportional to the heat of the combustor; and a controller electrically connected to the gas valve and the thermocouple, wherein the controller receives the thermoelectric potential from the thermocouple and controls the gas valve accordingly;

wherein the controller compares the thermoelectric potential with a low level, and controls the gas valve to stop the gas supplied to the combustor while the thermoelectric potential is lower than the low level;

wherein the controller compares the thermoelectric potential with a high level, and partially closes the gas valve to reduce the gas supplied to the combustor while the thermoelectric potential is lower than the high level and is higher than the low level;

wherein the low level is a predicted potential value, which indicates insufficient oxygen in the environment, and the high level is a predicted potential value too, which indicates sufficient oxygen in the environment;

wherein the thermoelectric potential decreases along with less oxygen around the combustor.

8. A gas appliance, comprising:

a combustor, which burns gas;

a gas pipe connected to the combustor to supply the combustor with gas;

a gas valve, which is activated by electrical signals, connected to the gas pipe to control the gas supplied to the combustor;

an air blower for supplying the combustor with air;

a thermocouple provided beside the combustor to generate a thermoelectric potential because of a heat of the combustor, wherein the thermoelectric potential is directly proportional to the heat of the combustor; and a controller electrically connected to the gas valve, the air blower and the thermocouple, wherein the controller receives the thermoelectric potential from the thermocouple and controls the gas valve and the air blower accordingly;

wherein the controller compares the thermoelectric potential with a low level, and controls the gas valve to stop the gas supplied to the combustor while the thermoelectric potential is lower than the low level;

wherein the controller compares the thermoelectric potential with a high level, and controls the gas valve to reduce the gas supplied to the combustor and speeds up the air blower while the thermoelectric potential is lower than the high level and is higher than the low level;

wherein the low level is a predicted potential value, which indicates insufficient oxygen in the environment, and the high level is a predicted potential value too, which indicates sufficient oxygen in the environment;

wherein the thermoelectric potential decreases along with less oxygen around the combustor.

* * * * *